US005273443A

United States Patent [19]

Frantz et al.

[11] Patent Number: 5,273,443

[45] Date of Patent: Dec. 28, 1993

[54] HIGH DENSITY CONNECTOR

[75] Inventors: Robert H. Frantz, Newville; Benjamin H. Mosser III, Middletown, both of Pa.

[73] Assignee: The Whitaker Corporation, Wilmington, Del.

[21] Appl. No.: 52,010

[22] Filed: Apr. 22, 1993

[51] Int. Cl.[5] ..... H01R 13/40

[52] U.S. Cl. ..... 439/595; 439/599; 439/744

[58] Field of Search ..... 439/586, 592, 594, 595, 439/596, 597, 598, 599, 744, 404

[56] References Cited

U.S. PATENT DOCUMENTS

| | | | |
|---|---|---|---|
| 3,905,672 | 9/1975 | Anhalt et al. | 439/599 |
| 4,443,048 | 4/1984 | Moist, Jr. | 339/63 M |
| 4,544,220 | 10/1985 | Aiello et al. | 339/59 M |
| 4,684,187 | 8/1987 | Rudy, Jr. et al. | 439/595 |
| 4,737,124 | 4/1988 | Ezure et al. | 439/610 |
| 4,749,373 | 6/1988 | Brekosky et al. | 439/595 |
| 4,820,199 | 4/1989 | Murslay | 439/599 |
| 4,960,389 | 10/1990 | Frantz et al. | 439/404 |

*Primary Examiner*—Larry I. Schwartz

*Assistant Examiner*—Hien D. Vu

[57] ABSTRACT

A high pin-density electrical connector of the type comprising a rear housing having openings for the passage of elongated, shouldered, electrical contacts through it, and having latching elements on its front face comprising spring fingers which close on the contacts behind their shoulders to latch them against withdrawal. A front housing provides recesses in which each of the latching elements and the front end of a corresponding one of the contacts are seated, with the sidewalls of the recesses providing support for the spring fingers. Close spacings of adjacent contacts are achieved by locating at least some of the recesses so close together that their walls intersect to form a communicating opening between them, and by placing the spring fingers circumferentially in their respective recesses so as to be in apposition to and supported by complete recess walls, rather than at the position of one of the communicating openings, where wall support for the fingers would be absent. Preferably the fingers in each recess are two in number, diametrically opposed to each other across the recess, and at 90° circumferentially from any communicating opening between the contiguous recesses.

6 Claims, 10 Drawing Sheets

HIGH DENSITY CONNECTOR

FIELD OF THE INVENTION

This invention relates to multiple-pin electrical connectors of the plug-and-socket type, and particularly to those in which a relatively large number of pin positions are to be accommodated in an assembly of relatively small diameter, for example in a plug and socket connector assembly of the so called MINI DIN type.

BACKGROUND OF THE INVENTION

In many plug and socket connectors it is desirable to provide a relatively large number of pin positions, i.e. pin or socket contacts, in an assembly the cross sectional area of which is limited. An example of such an assembly is the MINI DIN plug connector, a well-known commercial type of connector. Typically, in this example, it is relatively easy to provide six pin positions in the connector, but where, for example, nine positions are required, it is difficult to fit them all in, especially where alignment members are also to be provided on the confronting faces of plug and socket.

One type of pin contact which has been used where space is at a premium uses the so-called IDC termination such as is shown in U.S. Pat. No. 4,960,389 of R. H. Frantz and B. H. Mosser, issued Oct. 2, 1990. In this structure, each contact element has serrated or barbed portions along its sides which bite into the walls of a corresponding cavity, provided in an insulating housing to receive the contact element and hold it against pull-out. However, such a contact element is not positively held, and in some cases can be pulled out accidentally.

A more positive latching of the contact element is provided by the general type of structure shown in U.S. Pat. No. 4,544,220 of R. E. Alello, issued Oct. 1, 1985. This patent shows a rear housing through which the contact element extends, having on is forward face a hollow latching element for receiving and latching each contact element against pull-out; the latching element is hollow and frusto-conical in shape, with four longitudinal slots in it at 90° from each other circumferentially of the latch to form four identical spring fingers in each latching element. Each contact element has a shoulder such that when it is pushed through the rear housing and through a corresponding one of the latching elements, it first spreads the spring fingers apart until the shoulder is completely through the latching element, at which time the fingers spring radially inwardly behind the shoulder and latch the contact element against being withdrawn. The front housing is also provided with recesses for receiving the latching elements; each recess is geometrically similar to the corresponding latching element, i.e. is generally frusto-conical. The front and rear housings are advanced toward each other so that each contact element and its latching element enter into a corresponding recess in the front housing. These recesses fit closely about the radially outward surfaces of the latching elements to support the spring fingers, so that they cannot bow and then break easily in response to pull-out forces acting on the contact elements, and so they will not splay or spring apart to permit the connector elements to be pulled out; the connector elements are thereby positively latched and securely held in the latching elements.

The difficulty, as mentioned above, is that there is a limit to how many such contacts, recesses and latches can be readily and safely provided in a connector of limited cross-sectional size.

Accordingly, an object of this invention is to provide a multi-position connector having a high density of pin positions, in which the pins are positively secured against pull-out and in which the spring fingers resist breaking and/or splaying in response to pull-out forces acting on the cable wires.

SUMMARY OF THE INVENTION

In accordance with the invention, a connector is provided which has a rear housing having openings through it which are aligned with latching elements protruding from its front face; each latching element comprises one or more spring fingers for receiving and latching corresponding shouldered contact elements which are inserted into and through the rear housing openings and the latching elements. A front housing is provided which contains aligned, generally frusto-conical recesses for receiving and supporting the fingers of the latches after the front and rear housings are mated. At least some of the recesses are so closely positioned with respect to each other that they overlap or intersect, i.e. the wall between them is breached, and the recesses merge and communicate with each other in these regions. This enables the center lines of the recesses to be moved very close together, along with their corresponding connector elements. Further, each latch element in each such adjoining recess is constituted of spring fingers all of which bear against portions of the recess wherein the walls are complete, as opposed to portions from which the recess wall is missing at least in part. Preferably each latch element is divided into two spring fingers, each of which extends substantially 90° about the inner circumference of its encompassing recess, and is located in apposition to two corresponding portions of the recess wall which are at 90° circumferentially from the merged portions of the recess walls. The latch fingers are thus supported by complete walls with which they are in apposition, so as to resist bowing, breaking and splaying when the contact element is pulled rearwardly.

In this manner, the contact elements are placed more closely together than in earlier connectors of this general type, yet are well supported against pull-out forces.

BRIEF DESCRIPTION OF THE DRAWINGS

The various objects and features of the invention will be more readily understood from a consideration of the following detailed description taken with the accompanying in which.

DETAILED DESCRIPTION OF PREFERRED EMBODIMENTS

Figure 1:
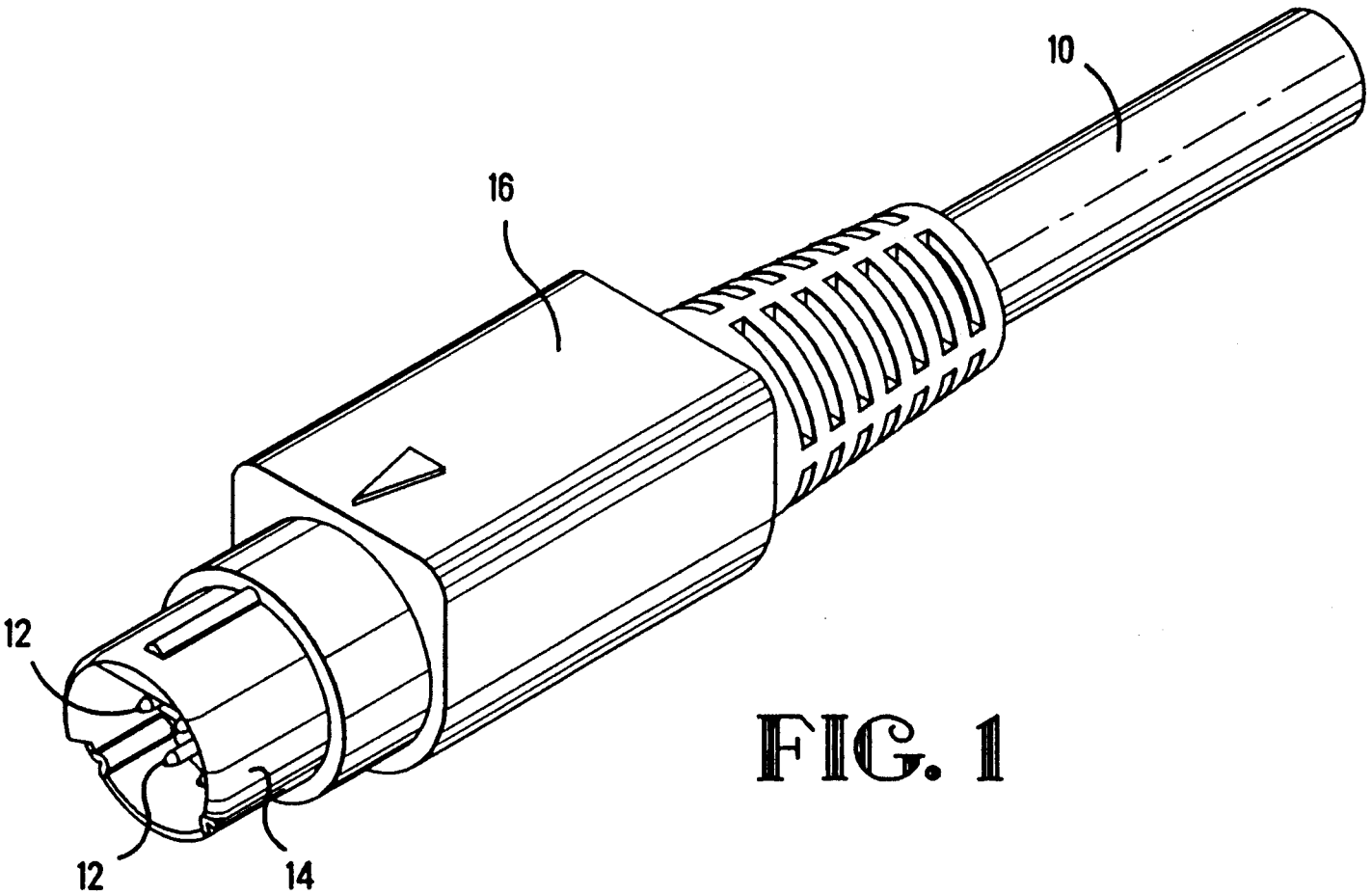
FIG. 1 is a perspective view of a contact element connector having an internal structure in accordance with the preferred embodiment of the invention shown in the other figures.

Referring now to the preferred embodiment of the invention shown in the drawings by way of example only, and without thereby in any way limiting the scope of the invention, there are shown the externals of a commercial type of connector designated as the MINI DIN plug connector which meets the electrical and geometric standards for that type of connector. In general, there is shown a cable 10 of mutually insulated wires (11 in FIG. 2) which are electrically connected to a corresponding number of contact elements or pins 12. The forward ends of the latter contacts are disposed and protected within a conductive front shell 14, which is configured and keyed to be matable with a corresponding connector of the same type. The contact elements 12 may be male or female, although in the following the invention will be described with particular reference to use of male connector pins for the contacts. The connector in this example has an external cover 16, which not only improves the appearance and handling of the connector but also provides some protection against excessive bending forces exerted on the cable near its input to the connector.

Figure 2:
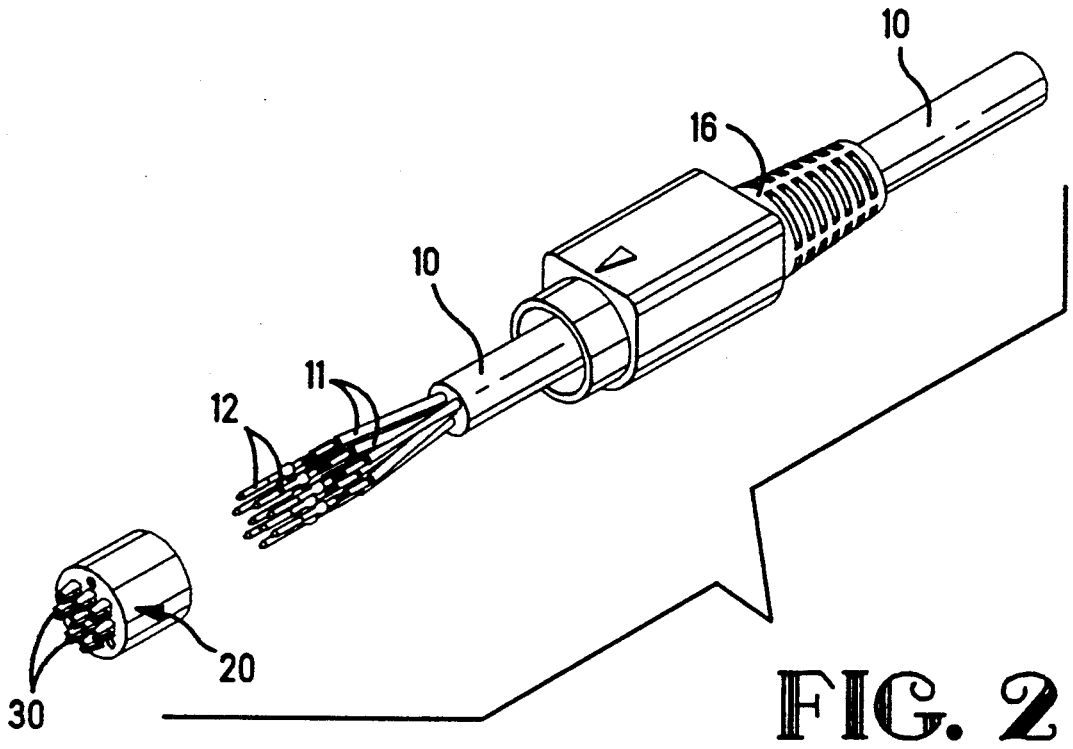
FIGS. 2-5 are perspective views showing the connector of FIG. 1 in successive stages of its assembly.
Figure 6:
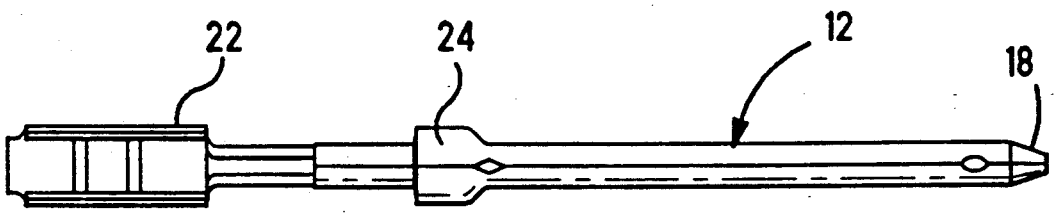
FIG. 6 is a side elevational view of a contact element used in this same preferred embodiment of the invention.
Figure 7:
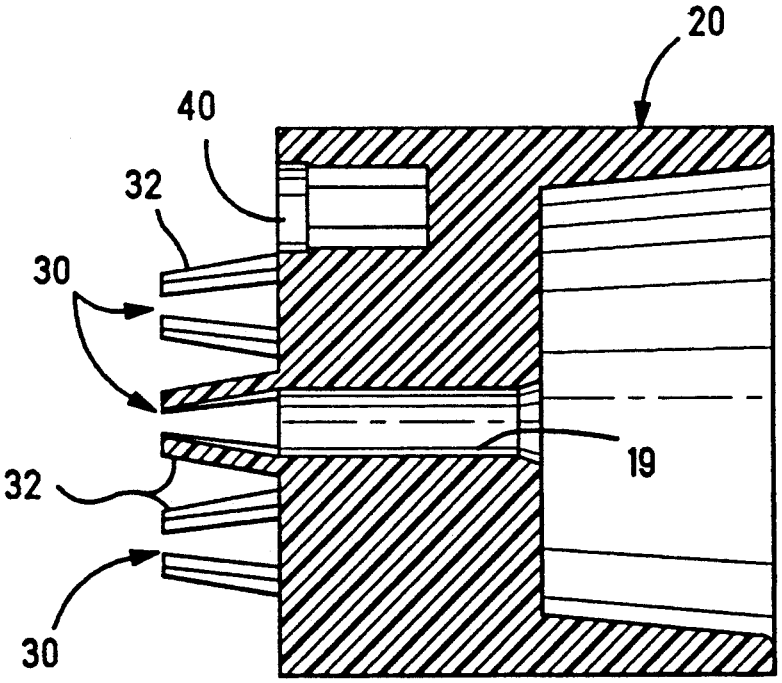
FIG. 7 is a cross-sectional view of the rear housing of the preferred embodiment, taken along lines 7—7 in FIG. 10.
Figure 8:
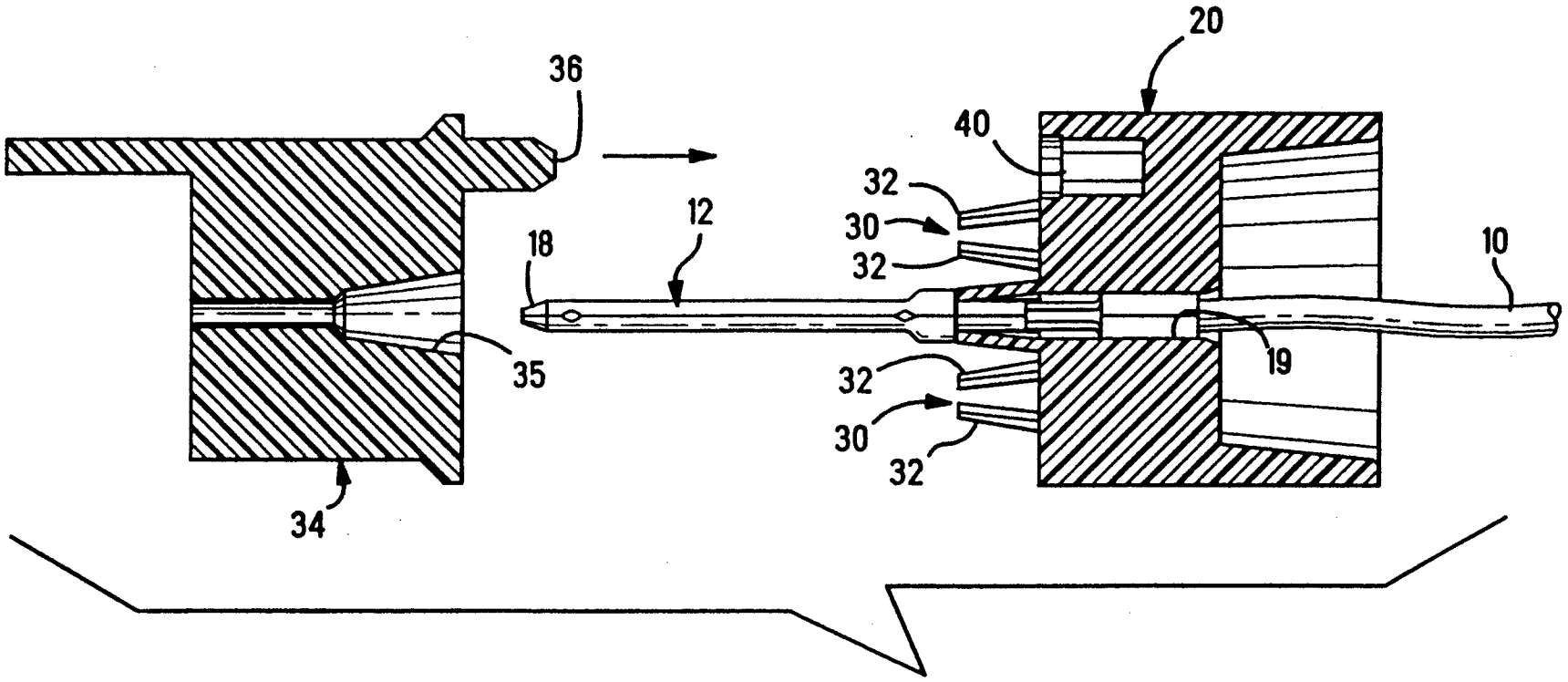
FIG. 8 is a cross-sectional view of the rear housing and of the front housing of the preferred embodiment of the invention, with a connector element shown in full and with the contact element in position on the rear housing, as it is about to be introduced into the front housing.
Figure 9:
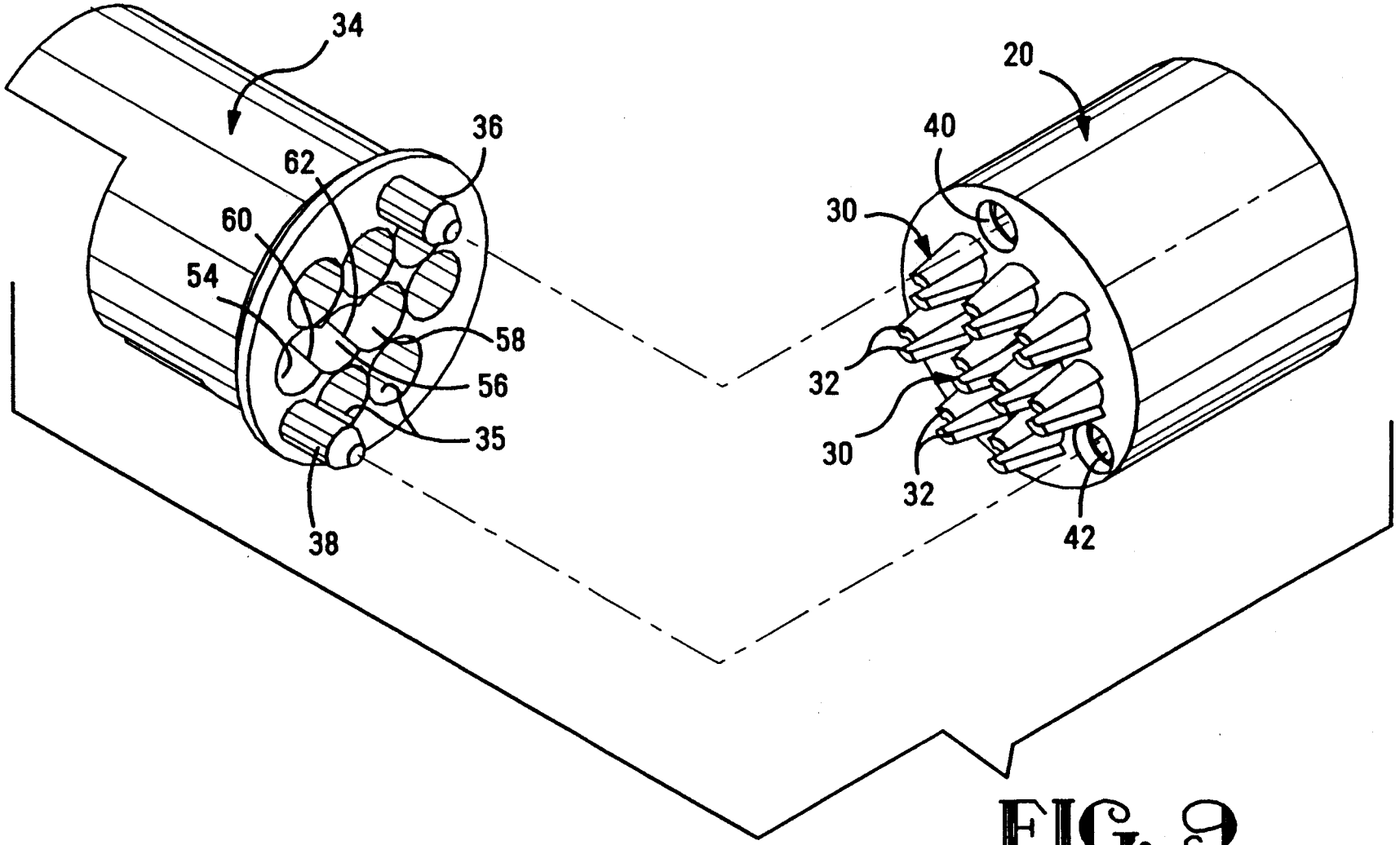
FIG. 9 shows the front and rear housings in perspective, with their mating partially faces confronting each other.

FIG. 2 shows an early step in the procedure for making the connector of FIG. 1, wherein the front end of the cable has been passed through the cover 16, the individual wires 11 in the cable have been stripped and the corresponding individual contact elements 12 have been crimped to the forward ends of the separate wires. FIG. 6 shows a typical contact element 12 having a tapered tip 18 facilitating its entry into an opening such as 19 (FIGS. 7 and 8) in the rear housing 20, having a crimpable portion 22 wherein the individual stripped wire is to be crimped, and having a radially protruding shoulder 24. The rear housing 20 is of insulating material, is substantially cylindrical in form and as mentioned is provided with the cylindrical openings such as 19 through which the contacts are passed until their tips such as 18 extend forwardly of the rear housing and are latched in that position.

Such latching is achieved by the provision of a plurality of latching members such as 30 (FIGS. 2, 3, 7, 8, 9, 11), each coaxial with, extending forwardly from, and in axial alignment with, a different one of the openings 19 in the rear housing; each of the latching members 30 is made up of a pair of resilient spring fingers such as 32 of hollow frusto-conical form. The end of each such latching member which is joined to the front face of the rear housing 20 is larger in internal diameter than the shoulder 24, whereas the unstressed distal end of each latching member is smaller in internal diameter than the outer diameter of the radial shoulder 24 of the contact element. Accordingly, when the contact element is advanced through the opening 19 and through the latching member 30 and its associated fingers 32, the spring fingers will separate to permit passage of the shoulder, but will spring back behind the shoulder so that when the contact element is thereafter urged rearwardly, the rear side of the shoulder will abut the forward tip ends of the fingers and be prevented from returning back through the latching element. Each connecting element is thereby latched against rearward motion once it has passed through its associated latching member. This condition is shown in FIG. 3.

Figure 3:
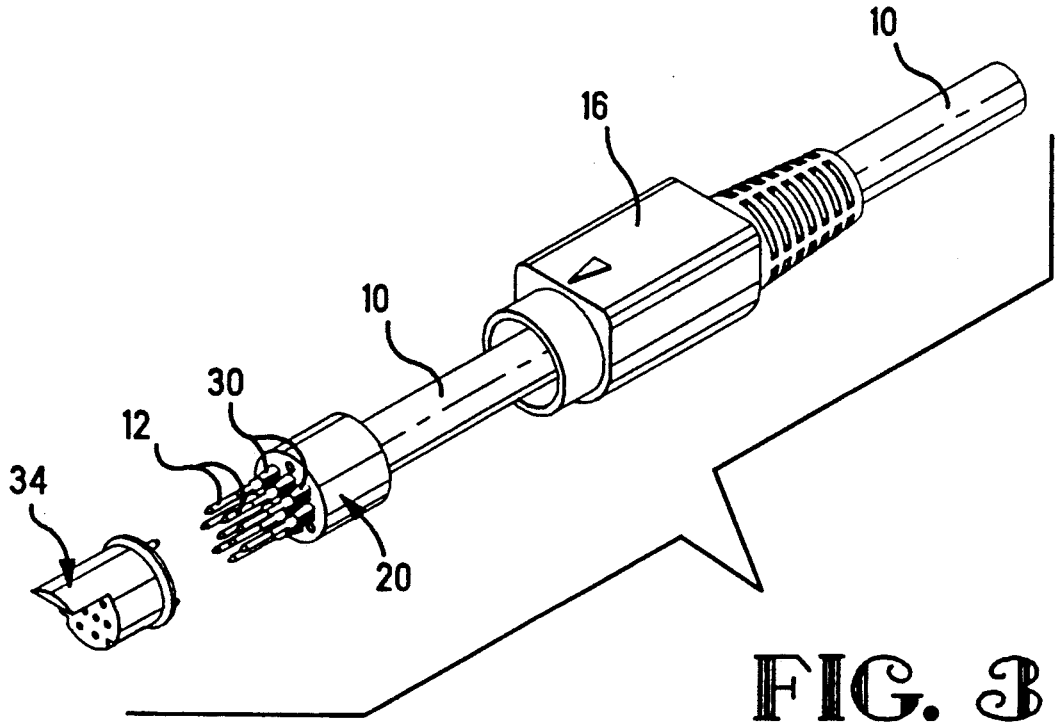

FIG. 3 also shows the front housing 34 which again is generally cylindrical in form, is of an electrically insulated material, and has recesses such as 35 in it, aligned to receive respective latching members protruding forwardly from the rear housing, when the two housings are advanced toward each other. Also provided on the front housing are a pair of alignment and locking pins 36 and 38 (FIG. 10), which form a press fit in corresponding holes 40 and 42 in the rear housing, whereby when the front and rear housings have been urged together firmly with the locking and alignment pins and sockets in alignment, they will remain locked together in this position.

Figure 4:
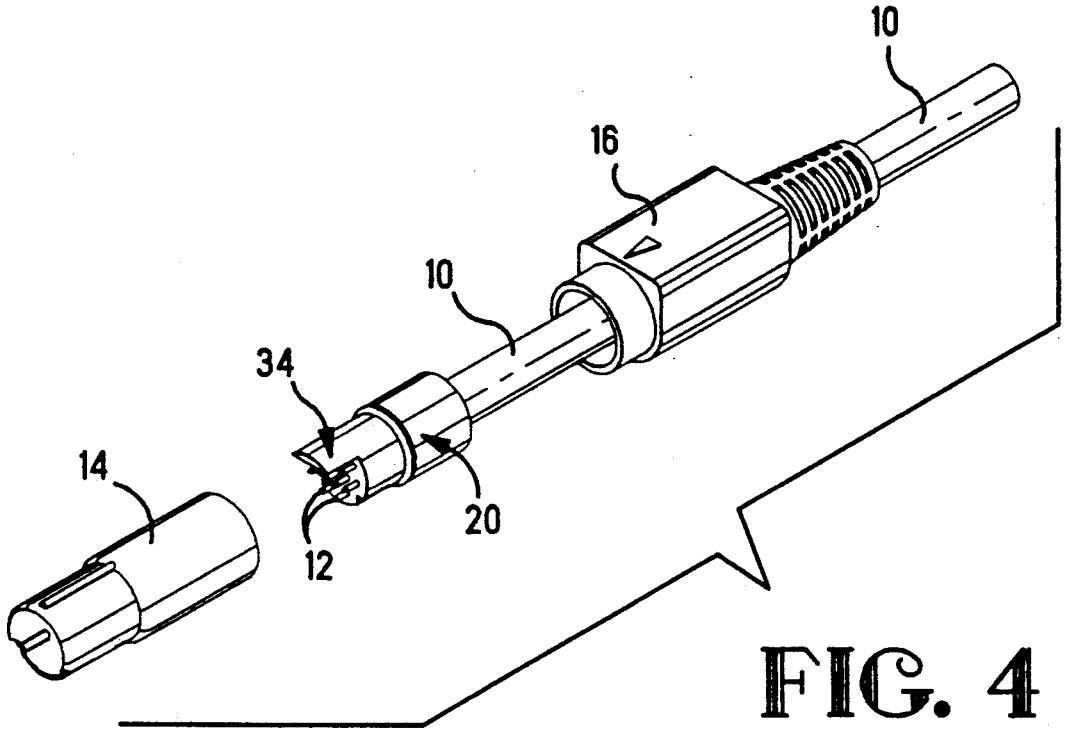
Figure 5:
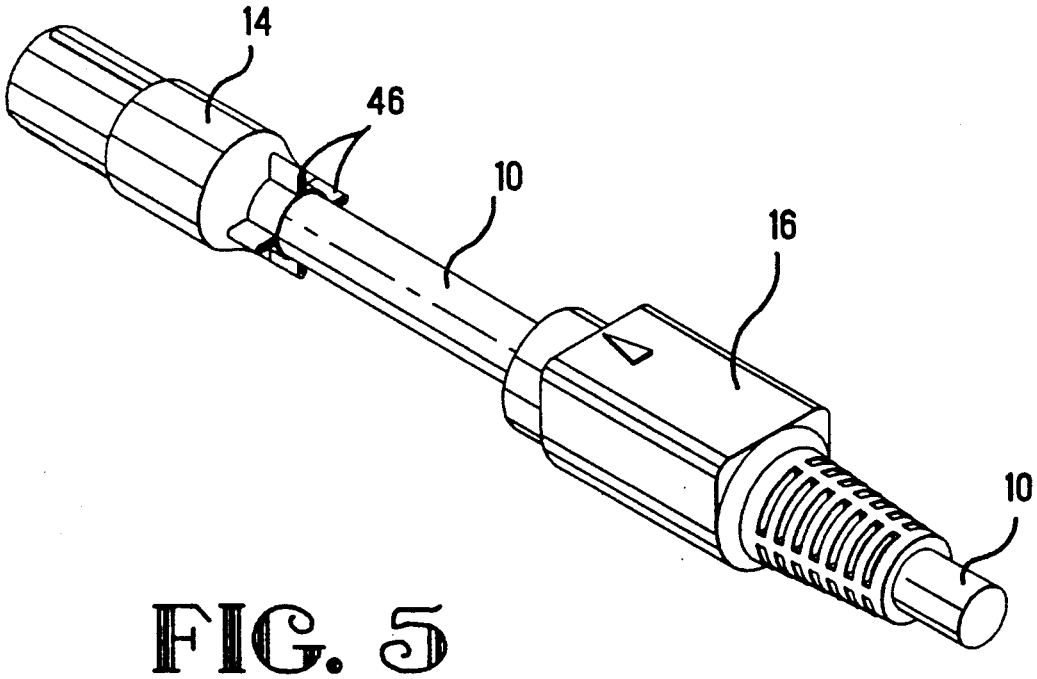

FIG. 4 shows the front and rear housings in their mated position, and with front shell 14 aligned therewith ready to be urged forwardly so as to be slid into position covering the front and rear housings as shown in FIG. 5. The rear side of the shell 14 is provided with crimpable elements 46, which when crimped against the exterior of the cable 10 hold the assembly in position on the cable. To proceed to the completed connector of FIG. 1 from the condition shown in FIG. 5, the cover 16 is advanced over the front and rear housings by pulling on the cable until the front and rear housings seat themselves within the cover.

Figure 10:
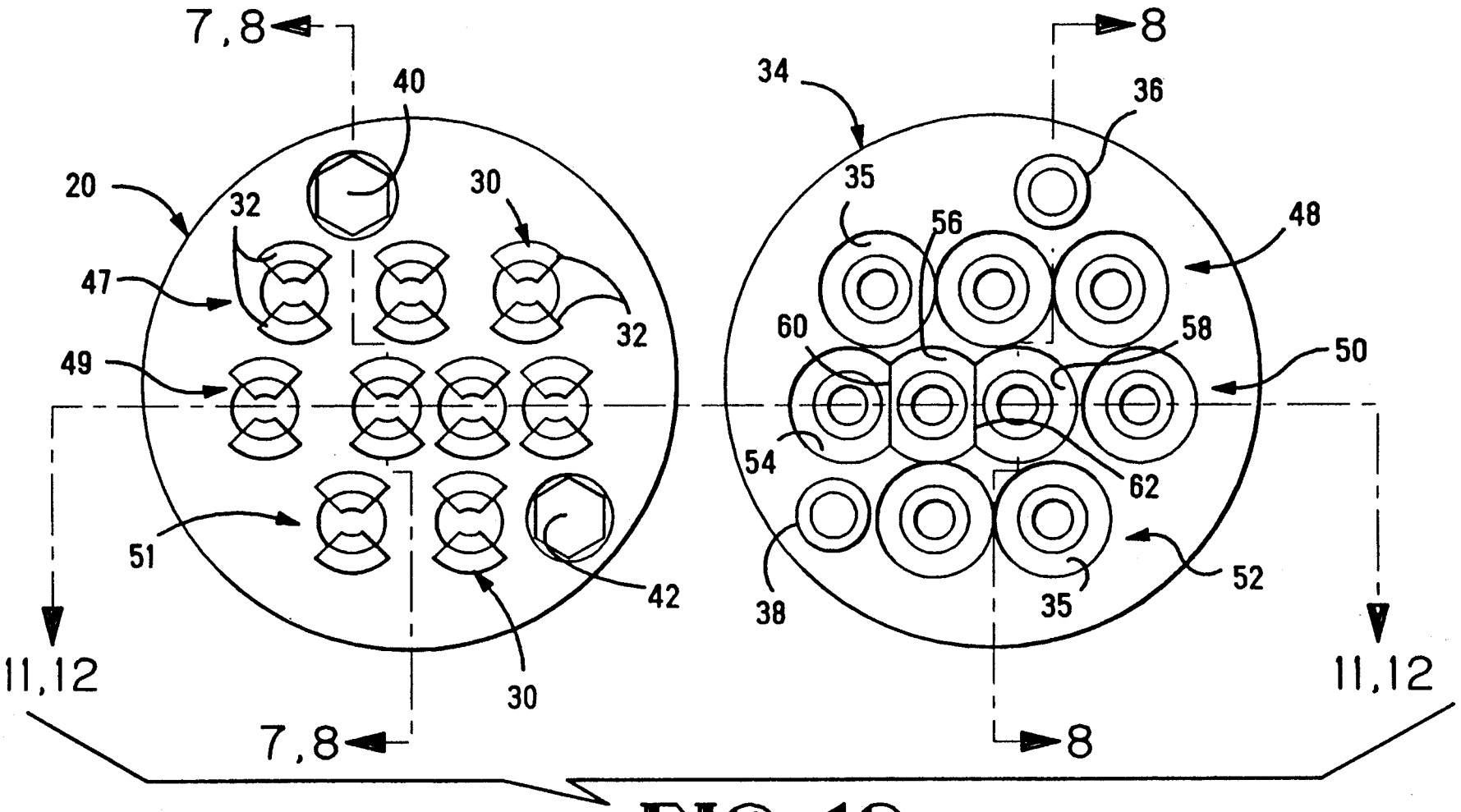
FIG. 10 is a plan view of the mating faces of the rear and front housings of FIG. 9, each turned so as to face the observer.
Figure 11:
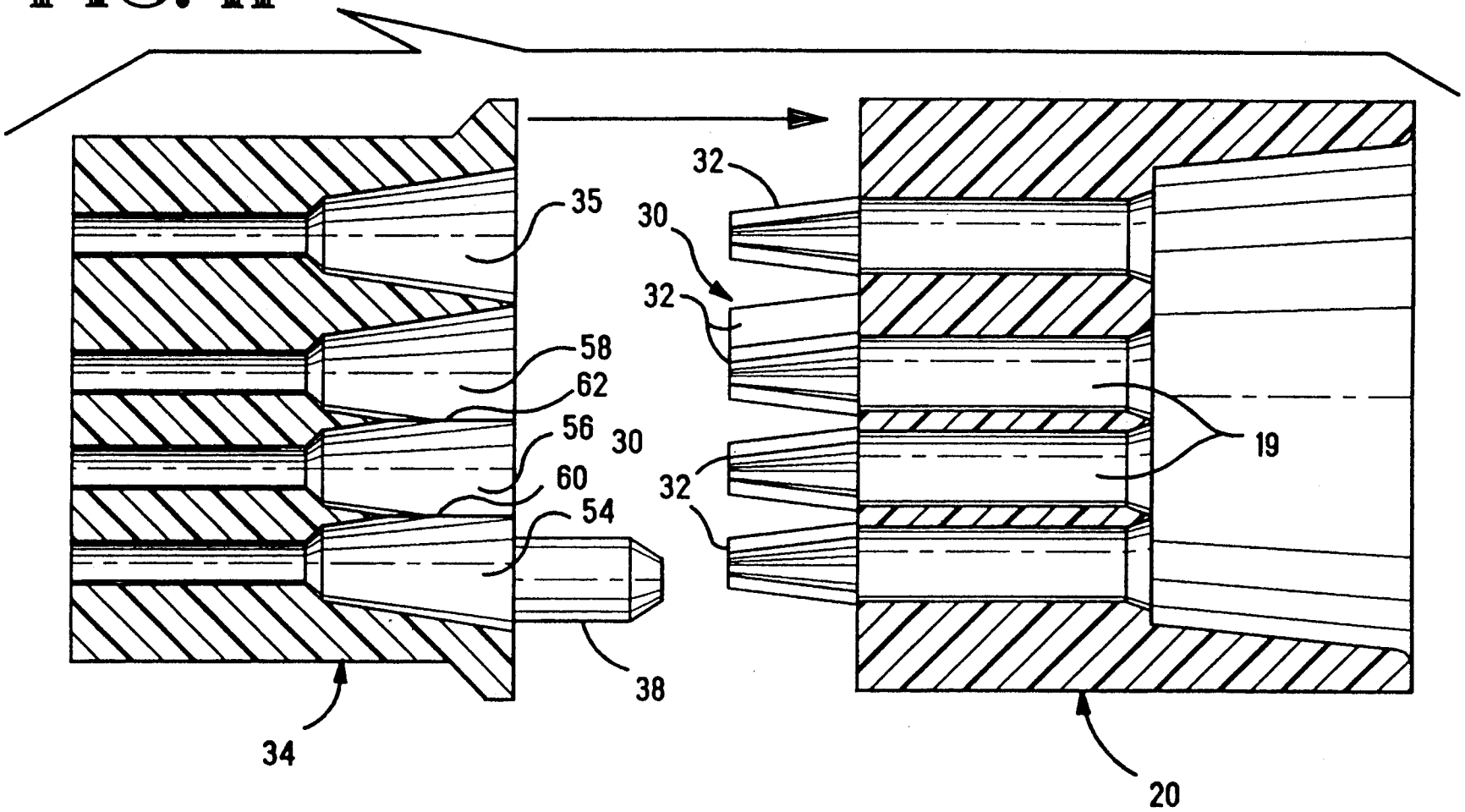
FIG. 11 is an enlarged sectional view of the rear housing, taken along lines 11—11 of FIG. 10.
Figure 12:
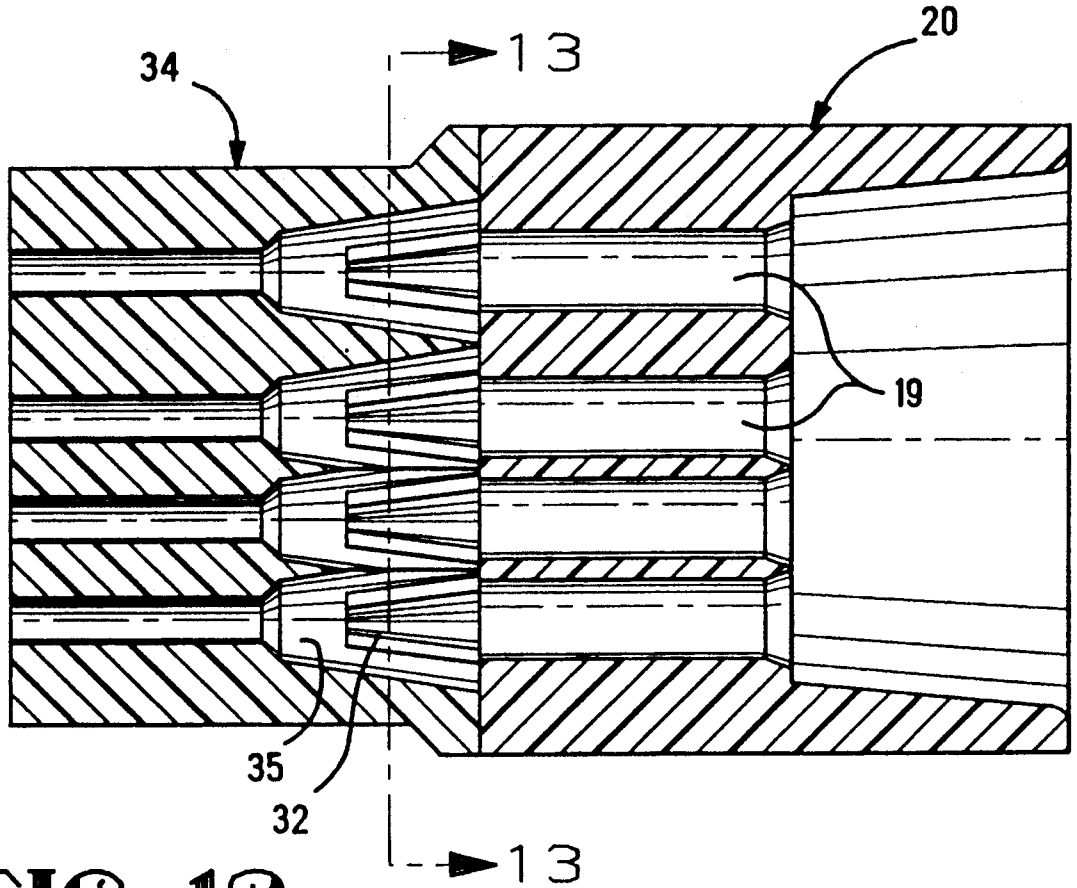
FIG. 12 is a correspondingly enlarged sectional view of the front housing, confronting and aligned with the rear housing of FIG. 11, and taken along lines 12—12 of FIG. 10.

One of the principal problems which the present invention solves will now be appreciated from the showings of FIG. 10 in particular. Here there are shown, at the left, a top row 47 of three latching members on the rear housing 20 and a row 48 of three corresponding conical recesses in the front housing 34; a central row 49 of four latching members and a central row 50 of four corresponding recesses; and finally, at the bottom, a row 51 of two additional latching members and a row 52 of two corresponding front housing recesses. In addition, FIG. 10 shows the pins 36, 38 and holes 40, 42 as described above, which hold the front and rear housings together, in proper alignment.

With this number of pins, the top rows of three latches and recesses and the bottom row of two latches and recesses are easily accommodated next to each other in the space available (see FIG. 10). However, in the middle row there are three sets of latches and three frusto-conical recesses which must be placed so close together that there is not room for the requisite number of full and complete front housing recesses, or for four full and complete latching fingers positioned around a complete 360° circle in each recess. In accordance with the invention, this difficulty is accommodated, and the desired density of pin positions realized, by permitting the three contiguous front housing recesses 54, 56 and 58 to be placed so close together that the wall between them disappears, and their centers are thereby spaced from each other by less than the diameter of a recess. This means that communicating openings such as 60 and 62 exist between recess 54 and recess 56, as well as between recess 56 and recess 58.

Figure 13:
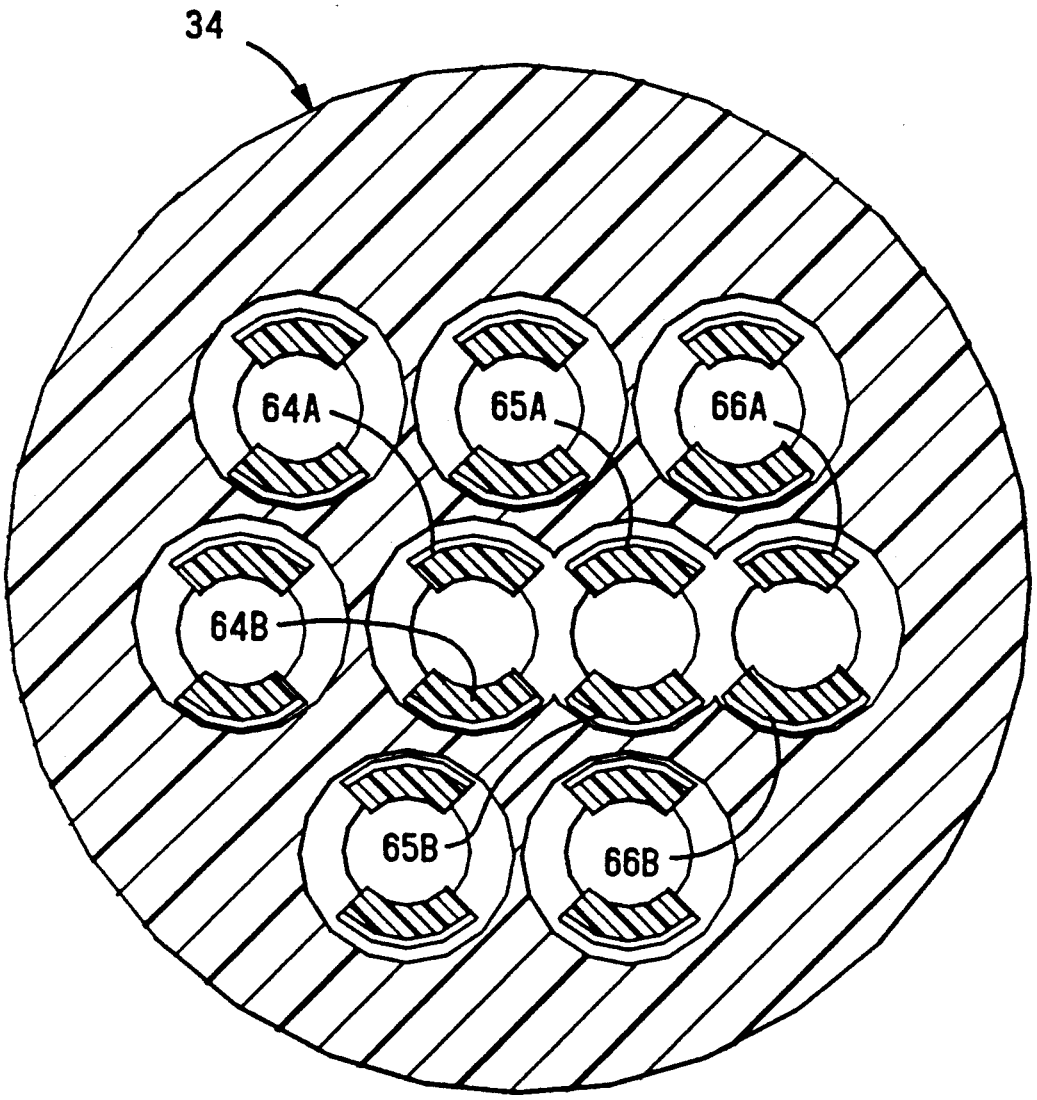
FIG. 13 is a cross sectional view of the front and rear housings assembled and mated together, but with the connector elements omitted in the interest of clarity to show clearly the geometric relationship of the latches and the recesses of the rear and front housings respectively.

Furthermore, as shown particularly clearly in FIG. 13, the spring fingers 64A, 64B, 65A, 65B, 66A, 66B of the latching members in these recesses are positioned in close apposition only to portions of the interior walls of the associated recesses which are not broken away by the merging of the adjacent front housing recesses. Thus, in this example, only two latching fingers are employed per recess, and they are positioned diametrically opposite each other, in positions at 90° circumferentially from the positions of the openings between the contiguous frusto-conical recesses. In this way, the spring fingers preventing withdrawal of the shoulder of the contact element are provided in close apposition to a complete interior wall of a corresponding recess, so as to be well supported by that wall against buckling, breaking, and splaying of the fingers which might permit the shoulder to move rearwardly between the spring fingers.

In the preferred embodiment of the invention described above, each of the latching members comprises a pair of diametrically opposed spring fingers circumferentially positioned so that, if inserted into a front housing recesses having a merged sidewall, they will still be supported completely from top to bottom by apposition to a complete interior wall of the corresponding recess. However, others of the latching elements may extend into front housing recesses which are far enough apart to have complete sidewalls, and four fingers at 90° to each other may be used in such recesses as in certain prior art devices. Furthermore, even as to those latching elements which enter into front housing recesses having incomplete sidewalls, the spring fingers need not be in the diametrically opposed, 90° positions of the preferred embodiment, so long as their size and number is such that each is positioned in apposition to a substantially complete sidewall of the recess; for example, if only one side of a front housing recess is open to an adjoining recess, one can use three spring fingers spaced from each other by 90° , none of them at the sidewall opening. Similarly, the recesses may be merged at two circumferential position which are not necessarily diametrically opposed; also, a recess may be merged with recesses positioned on more than two of its sides, in which case appropriate spring fingers can still be provided at suitable positions between the sidewall openings. For example, when providing for four sidewall openings at 90° to each other, one can utilize four 90° spaced spring fingers each located between a pair of the four sidewall openings. However, using more spring finger elements and more merged front housing recesses than are shown in the preferred embodiment is generally accompanied by a need for finer control in the fabrication of the corresponding smaller spring fingers, placing practical limitations on the ease of molding the parts inexpensively. While the invention has been described with particular reference to specific embodiments in the interest of complete definiteness, it will be understood that it may be embodied in a variety of forms diverse from those specifically shown and described, without departing from the spirit and scope of the invention.

We claim:

1. An electrical connector system of the type comprising a plurality of elongated contact elements each having a radial shoulder; an electrically insulating rear housing having openings therethrough; a plurality of hollow, resilient frusto-conical latching elements extending forwardly from a front face of said rear housing in alignment with said openings therein; said latching elements each being of a plurality of circumferentially spaced apart spring fingers; each of said contact elements extending through one of said rear housing openings and an associated latching element, with said shoulder thereof positioned forward of and adjacent to a distal end of the associated latching element and with said spring fingers closed behind said shoulder to prevent pull-out of said each contact element from the associated latching element; and a front housing having a plurality of recesses extending therethrough and aligned with said latching elements; each of said latching elements, with the contact element positioned therein, being positioned within a corresponding one of said recesses; each of said recesses having walls in close apposition to the latching element contained therein to provide support therefor;

the improvement wherein at least a pair of said front housing recesses having adjacent sidewalls are sufficiently close to each other that portions of said adjacent sidewalls intersect to produce a communicating opening between said pair of recesses, and wherein said spring fingers in each of said pair of recesses extend only along those portions of the walls of the recess in which they are located which are circumferentially spaced from said communicating opening.

2. The system of claim 1, wherein said spring fingers in each of said pair of recesses are two in number.

3. The system of claim 2, wherein said two spring fingers in each of said pair of recesses are positioned diametrically opposite each other and at about 90° circumferentially from the center of said communicating opening.

4. The system of claim 3, wherein said recesses are at least three in number and are positioned in a row, with said adjacent sidewalls of a central one of said recesses intersecting said adjacent sidewalls of the two recesses on either side thereof, thereby to form a communicating opening between said central recess and each of the two recesses.

5. The system of claim 1, wherein said spring fingers of each of said latching members are formed by slots in said latching members extending from the distal ends of said latching members toward said rear housing.

6. The system of claim 1, comprising an arrangement of aligning and locking pins and corresponding sockets, on confronting faces of said front and rear housings, for locking said front and rear housings together in proper alignment with each other.

* * * * *

UNITED STATES PATENT AND TRADEMARK OFFICE

CERTIFICATE OF CORRECTION

PATENT NO. : 5,273,443

DATED : December 28, 1993

INVENTOR(S) : Robert H. Frantz; Benjamin H. Mosser, III

It is certified that error appears in the above-indentified patent and that said Letters Patent is hereby corrected as shown below:

Column 6, line 14,

Claim 1, Line 8 - Delete "of"

Signed and Sealed this

Twenty-fifth Day of April, 1995

*Attest:*

*Attesting Officer*

BRUCE LEHMAN

*Commissioner of Patents and Trademarks*